US006785910B2

(12) United States Patent
Zic et al.

(10) Patent No.: US 6,785,910 B2
(45) Date of Patent: Sep. 7, 2004

(54) SWIMSUIT CONVERTER

(76) Inventors: Doreen Theresa Zic, 403 Oregon La., Boca Raton, FL (US) 33487; John Raymond Hock, 403 Oregon La., Boca Raton, FL (US) 33487

( * ) Notice: Subject to any disclaimer, the term of this patent is extended or adjusted under 35 U.S.C. 154(b) by 17 days.

(21) Appl. No.: 10/215,932

(22) Filed: Aug. 10, 2002

(65) Prior Publication Data

US 2003/0196241 A1 Oct. 23, 2003

Related U.S. Application Data

(60) Provisional application No. 60/374,580, filed on Apr. 23, 2002.

(51) Int. Cl.[7] ..... A41D 13/00

(52) U.S. Cl. ..... 2/67; 2/323; 2/326

(58) Field of Search ..... 2/67, 69, 336–338, 2/73, 78.1–78.4, 227, 228, 238, 217, 400, 403, 406, 323–326, 341, 342, 271, 269, 244, 246, 105, 106, 96, 243.1, 109–115; 24/3.1, 4, 3.13, 3.12, 713 D, 68 J, 20 R, 22, 234, 326, 327; D2/704, 705, 731, 625, 633–635, 639, 640; 63/3, 4, 9, 10, 12; 223/111

(56) References Cited

U.S. PATENT DOCUMENTS 1,457,350 A * 6/1923 Damiano ..... 450/86
1,491,578 A * 4/1924 Ballou et al. ..... 450/86
3,052,891 A * 9/1962 Panepinto ..... 2/323
3,456,457 A * 7/1969 Cass ..... 63/3
3,654,630 A * 4/1972 Block ..... 2/67
4,028,740 A * 6/1977 Luerken ..... 2/67
6,081,925 A * 7/2000 Reiber ..... 2/125
6,240,560 B1 6/2001 DeCaro ..... 2/67
6,279,171 B1 * 8/2001 Brancato ..... 2/326

* cited by examiner

*Primary Examiner*—Gloria M. Hale
(74) *Attorney, Agent, or Firm*—Yi Li

(57) ABSTRACT

A swimsuit converter is provided for converting the bottom rear panel of a swimsuit to a shape with more body exposures. The swimsuit converter includes a center connection part, and a plurality of extensions, each with one end connected to the center connection part and with another end connected to an attachment structure. When in use, a swimsuit wearer attaches two extensions through the attachment structures to two sides of a bottom rear panel of a swimsuit and attaches one or more extensions to one or more locations around the waist portion of the swimsuit. The swimsuit converter holds the swimsuit rear panel together, and converts a conventional or bikini style swimsuit to a thong style, which is particularly suitable for sun bathing and sun tanning.

16 Claims, 7 Drawing Sheets

SWIMSUIT CONVERTER

This application claims the benefit of Provisional application No. 60/374,580 filed Apr. 23, 2002.

FIELD OF THE INVENTION

The present invention relates in general to swimsuit accessories, and more particularly to a device which enables conversion of bottom rear panel of a swimsuit from a conventional or bikini style to a thong style, and is particularly suitable for sun bathing and tanning.

BACKGROUND OF THE INVENTION

Thong-type bikini swimsuit bottoms and briefs are known in the art. They are particularly suitable for sun tanning because of large areas of body exposure. However, extensive body exposures can also be embarrassing to many users when walking around in a public area, such as at a beach or a resort.

On the other hand, one-piece swimsuits or bikini swimsuits have less body exposures. It is more comfortable to wear one-piece or bikini swimsuits at a beach or at a pool party. However, when the swimsuit wearer is exposed to the sun or the lamps of a tanning booth, these types of swimsuits will leave a white outline of the shape of the garment. The white outline will often be seen when the person wears a swimsuit or other piece of clothing having a shape different from the one used to obtain the tan.

Therefore, because of the above-described reasons, it is desirable to have different types of swimsuits and to select the appropriate one for a specific purpose and occasion. However, this can be costly and inconvenient. Particularly with a two-piece bikini swimsuit, the top portion already provides a sufficient body exposure. To obtain sun tan around the buttocks, one needs to change to a thong style swimsuit.

U.S. Pat. No. 6,240,560 (to DeCaro) discloses a versatile swimsuit with accessories, which utilizes a band wrap at selected areas to change the shape of a bikini top, adjust the cut, and style of a swimsuit. More particularly, DeCaro teaches using a band wrap to wrap the rear panel of a swimsuit together to provide a thong style like swimsuit. The band wrap is made of a flexible material including elastic between the opposing inner and outer fabric panel. However, although using a band wrap to wrap a small area may be feasible, to wrap an entire rear panel into a tubular band wrap can be difficult and uncomfortable. Furthermore, the band wrapped rear panel has a poor appearance, which will affect negatively on a user's interest.

Based on the above discussion, it is apparent that it is desirable to have a swimsuit accessory device which enables a convenient conversion of a conventional or a bikini swimsuit style to a thong style as needed. It is also desirable to have a decorative swimsuit converter which enhances appearance of the converted thong style.

SUMMARY OF THE INVENTION

In one embodiment, the present invention is directed to a swimsuit converter comprising a plurality of extensions, each extension having a first end portion and an opposing second end portion connected to an attachment means, the first end portions of the plurality of extensions being connected together; wherein attaching two of the extensions through the attachment means to two sides of a bottom rear panel of a swimsuit and attaching one or more the extensions through the attachment means to one or more locations around the waist portion of the swimsuit enables a conversion of the bottom of the swimsuit to a shape which provides more body exposure.

In a further embodiment, the swimsuit converter of the present invention comprises a center connection means; and a plurality of extensions, first end portions of the extensions being connected to the center connection means, and an attachment means being connected to a second end portion of each of the extensions. Alternatively, the extensions are foldable at the second ends for attaching to the swimsuit; therefore, no attachment means are required.

In an alternative embodiment, the swimsuit converter has two extensions with one end connected to the center connection means, and another end connected to an attachment means. When in use, a swimsuit wearer attaches one extension through the attachment means to a location around the waist portion of a bottom rear panel of a swimsuit and enfolds the bottom rear panel of a swimsuit with the second extension, and connects the attachment means of the second extension to the center connection means to hold the rear panel together.

In another embodiment, a swimsuit converter of the present invention comprises a first extension, each of two end portions of the first extension having a connection means enabling interconnection between the two connection means, and a second extension, with a first end connected to a point along the first extension, and with a second end portion connected to an attachment means. When in use, a swimsuit wearer attaches the attachment means of the second extension to a location around the waist portion of a bottom rear panel of a swimsuit and has the first extension enfolding the bottom rear panel of the swimsuit, and interconnects the two connection means to convert a swimsuit style.

In an additional embodiment, the present invention provides a kit for making a swimsuit converter.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
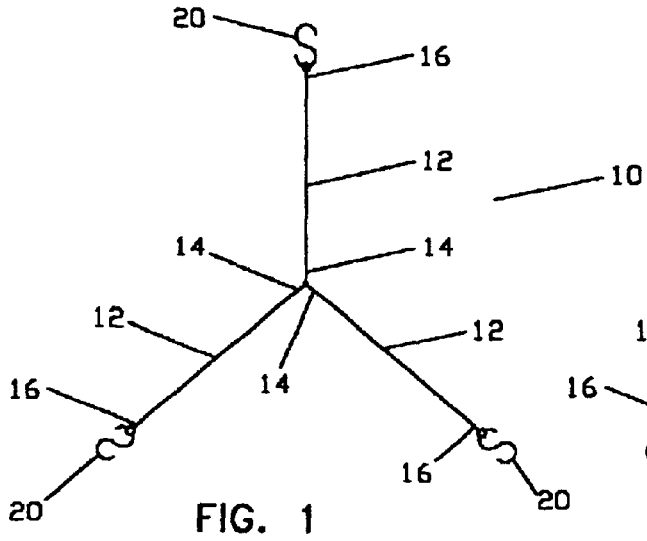
FIG. 1 is a perspective view of a swimsuit converter of one embodiment of the present invention.

Referring now to the drawings, FIG. 1 shows one example of one embodiment of the swimsuit converter of the present invention. The swimsuit converter 10 comprises a plurality of extensions 12, first end portions 14 of extensions 12 being connected together; and an attachment means 20 being connected to a second end portion 16 of each extension 12.

Figure 2:
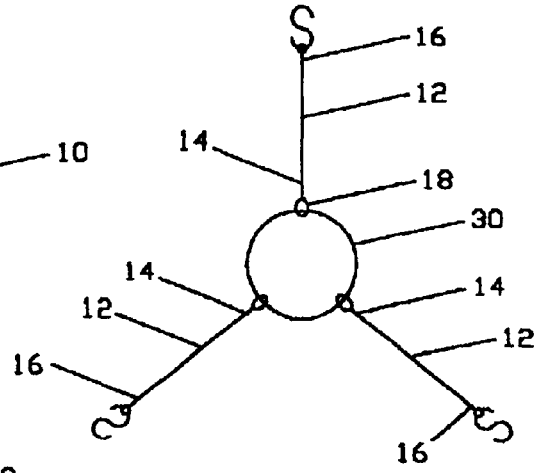
FIG. 2 is a perspective view of a swimsuit converter with a circular center connection means of one embodiment of the present invention.

In a more preferred embodiment as shown in FIG. 2, swimsuit converter 10 comprises a center connection means 30; and a plurality of extensions 12, a first end portion 14 of each extension 12 being connected to center connection means 30; and an attachment means 20 being connected to second end portion 16 of each extension 12.

Figure 3:
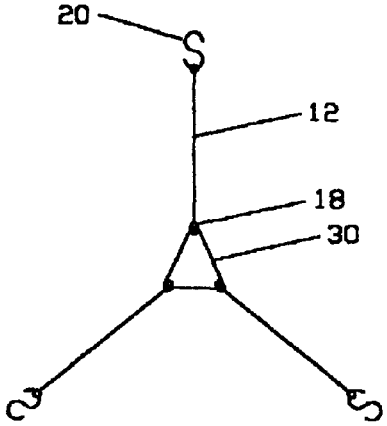
FIG. 3 is a perspective view of a swimsuit converter with a triangular center connection means of one embodiment of the present invention.
Figure 4:
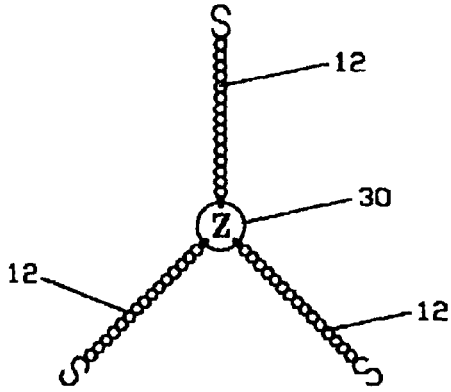
FIG. 4 is a perspective view of a swimsuit converter with a decorative center connection means and extensions of one embodiment of the present invention.

The center connection means 30 can be in various shapes, such as a circular ring as shown in FIG. 2, a triangular ring as shown in FIG. 3, or other suitable shapes. As shown in FIG. 4, center connection means 30 can be a circular plate with a plurality of apertures around the periphery of the circular plate for connecting with a plurality of extensions 12. Furthermore, center connection means 30 can have various sizes. Additionally, center connection means 30 can be decorative with printings, such as designer logos, brand names or cartoon characters; or decorative with patterns.

The center connection means 30 can be made of a variety of materials. Suitable examples include metal, plastic, rubber and fabric.

The extension 12 can be connected directly to center connection means 30, for example tied on, welded on, or through an additional connection ring 18 as shown in FIGS. 2 and 3. With connection ring 18, extension 12 can be moved freely around center connection means 30, which provides flexibility in adjusting attachment positions.

Extension 12 can be chains, strips, strings, connected beads, connected loops. They can be made of variety of materials, including metal, plastic, rubber, fabric, elastic material, string, and beads. Extension 12 can also be decorative, with colors, decorative patterns, and decorative material surfaces. FIG. 4 shows extensions 12 made of stringed beads, and with a designer logo printed on the surface of center connection means 30. With decorative designs, the swimsuit converter of the present invention can be made like jewelry, which will not only service as a swimsuit accessory for style conversion, but also function as swimsuit decoration.

Figure 9A:
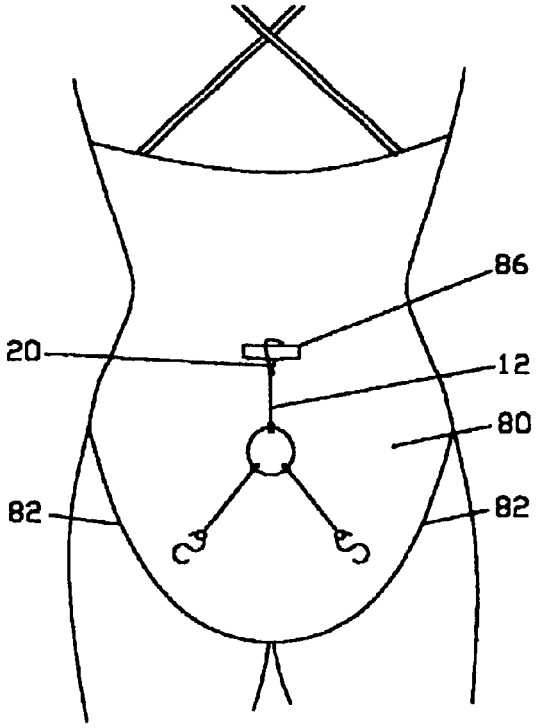
FIG. 9A shows a swimsuit converter with one attachment means attached to a loop on the rear panel of a one-piece swimsuit.

The attachment means 20 can be hooks, buttons, clasps, clamps, snaps, loop and hook fasteners, or other suitable means. The plurality of attachment means 20 in one swimsuit converter can be the same, and can also be different. FIGS. 1 to 5 show illustrative examples of attachment means 20 as S-shape hooks. In FIG. 9A, one of attachment means, attached to loop 86 of the swimsuit, is a loop and hook fastener.

Figure 6A:
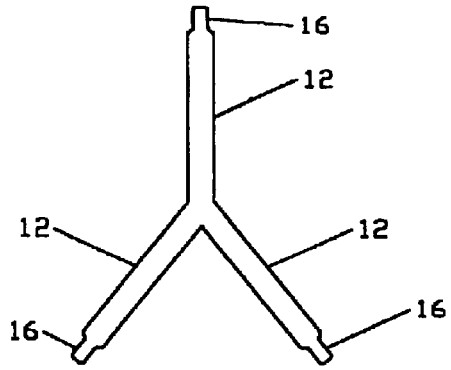
FIGS. 6A and 6B show a swimsuit converter with foldable extensions of one embodiment of the present invention.
Figure 6B:
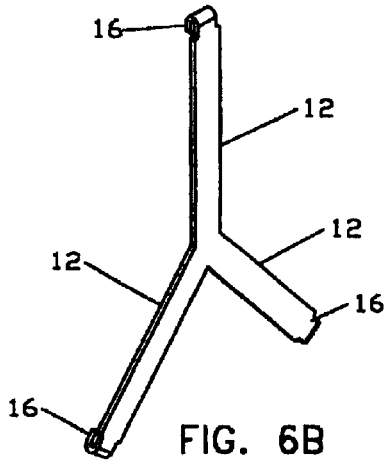

In an alternative embodiment, extensions 12 are made of foldable material such as aluminum strip. With this type of extension, no additional attachment means are required. The second end portion 16 itself can function as an attachment means, as shown in FIGS. 6A and 6B.

Figure 7A:
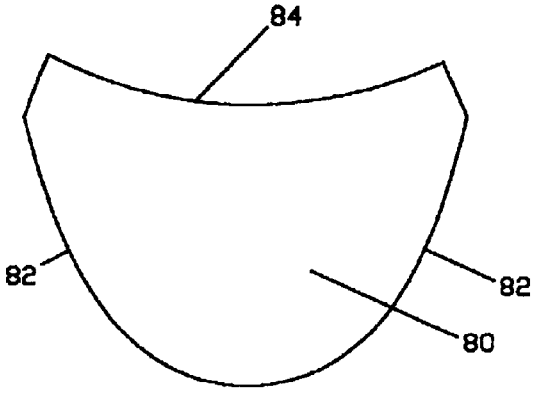
FIG. 7A shows a bottom rear panel of a bikini swimsuit.
Figure 7B:
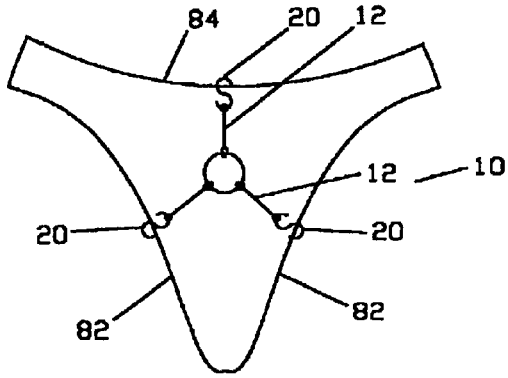
FIG. 7B shows the bottom rear panel of the bikini swimsuit of FIG. 7A after being converted to a thong style by applying the swimsuit converter of the present invention.

When in use, a swimsuit wearer attaches two extensions 12 of swimsuit converter 10 through attachment means 20 to two sides 82 of a bottom rear panel 80 of a swimsuit, as shown in FIG. 7B, and attaches one or more extensions 12 through attachment means 20 to one or more locations around the waist portion of the swimsuit, such as top edge 84 of rear panel 80 in FIG. 7B. The two extensions 12 attached to two sides 82 pull the swimsuit bottom rear panel together and hold rear panel 80 around the center, which converts a bikini or conventional style to a thong style. Therefore, using the swimsuit converter of the present invention, one can conveniently convert a rear panel of a swimsuit to a shape which provides more body exposure for sun tanning.

Figure 8:
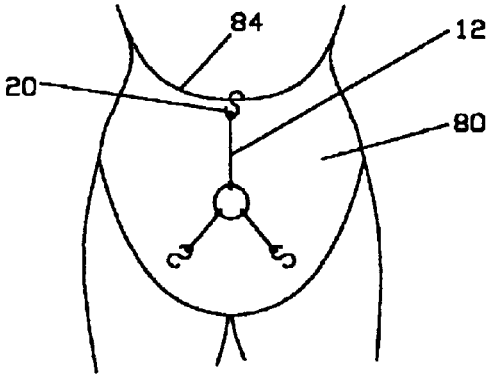
FIG. 8 shows a swimsuit converter having one attachment means attached to the top edge of the bottom rear panel of a one-piece swimsuit.
Figure 9B:
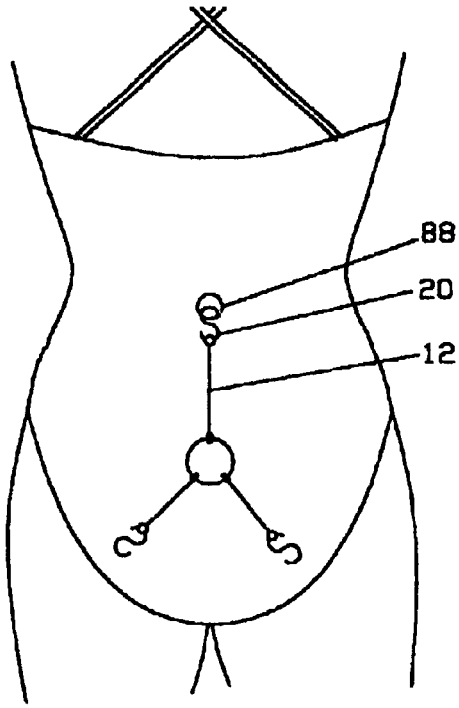
FIG. 9B shows a swimsuit converter with one attachment means attached to an attachment opening on the rear panel of a one-piece swimsuit.

FIGS. 7A and 7B illustrate the use of swimsuit converter 10 of the present invention to convert a rear panel of a two-piece bikini swimsuit to a thong style. The swimsuit converter of the present invention can also be used for converting a one-piece swimsuit. FIG. 8 shows a one-piece swimsuit which has a low back cut. As shown, one of extension 12 of swimsuit converter 10 can be attached to top edge of rear panel 80, similar to the use with bikini swimsuit shown in FIG. 7B. FIGS. 9A and 9B show that a one-piece swimsuit can have a built-in attachment location for use with the swimsuit converter of the present invention. In FIG. 9A, a one-piece swimsuit has a loop 86 around the waist portion on rear panel 80. In FIG. 9B, a one-piece swimsuit has an attachment hole 88 around the waist portion of rear panel 80, and attachment hole 88 can further be decorated. As shown, one of extension 12 can be attached to loop 86, or attachment hole 88, and two extensions 12 can be attached to the two sides 82 of rear panel 80 as illustrated previously.

Figure 13A:
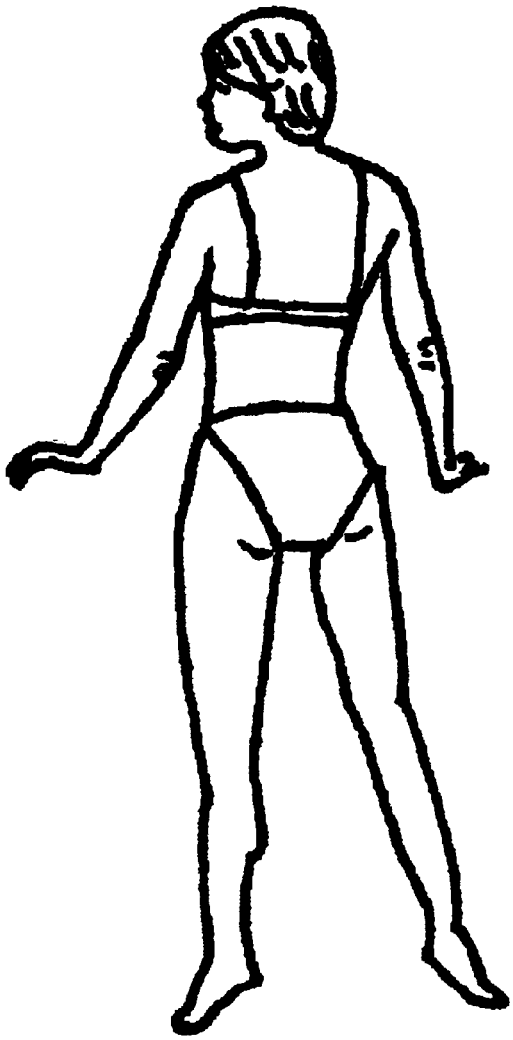
FIGS. 13A and 13B illustrate the application of a swimsuit converter of present invention to convert a swimsuit from a bikini style to a thong style.
Figure 13B:
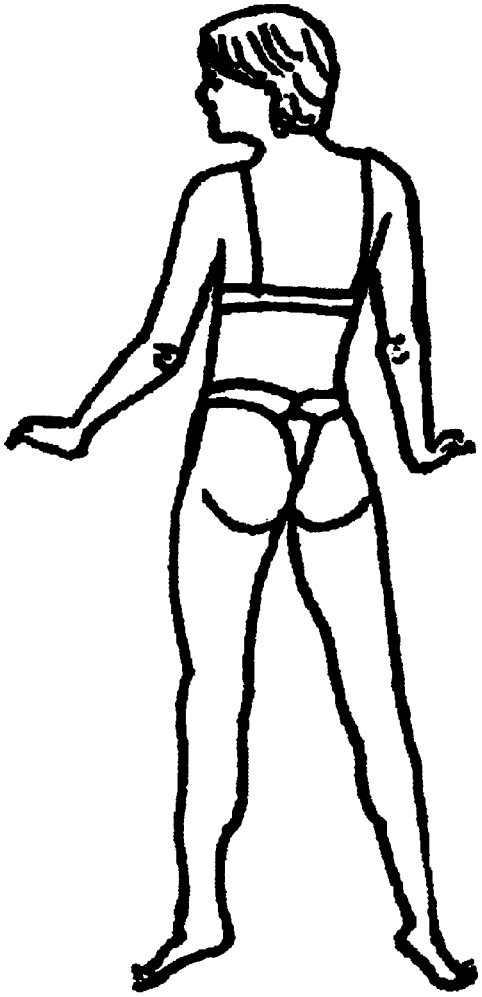
Figure 14:
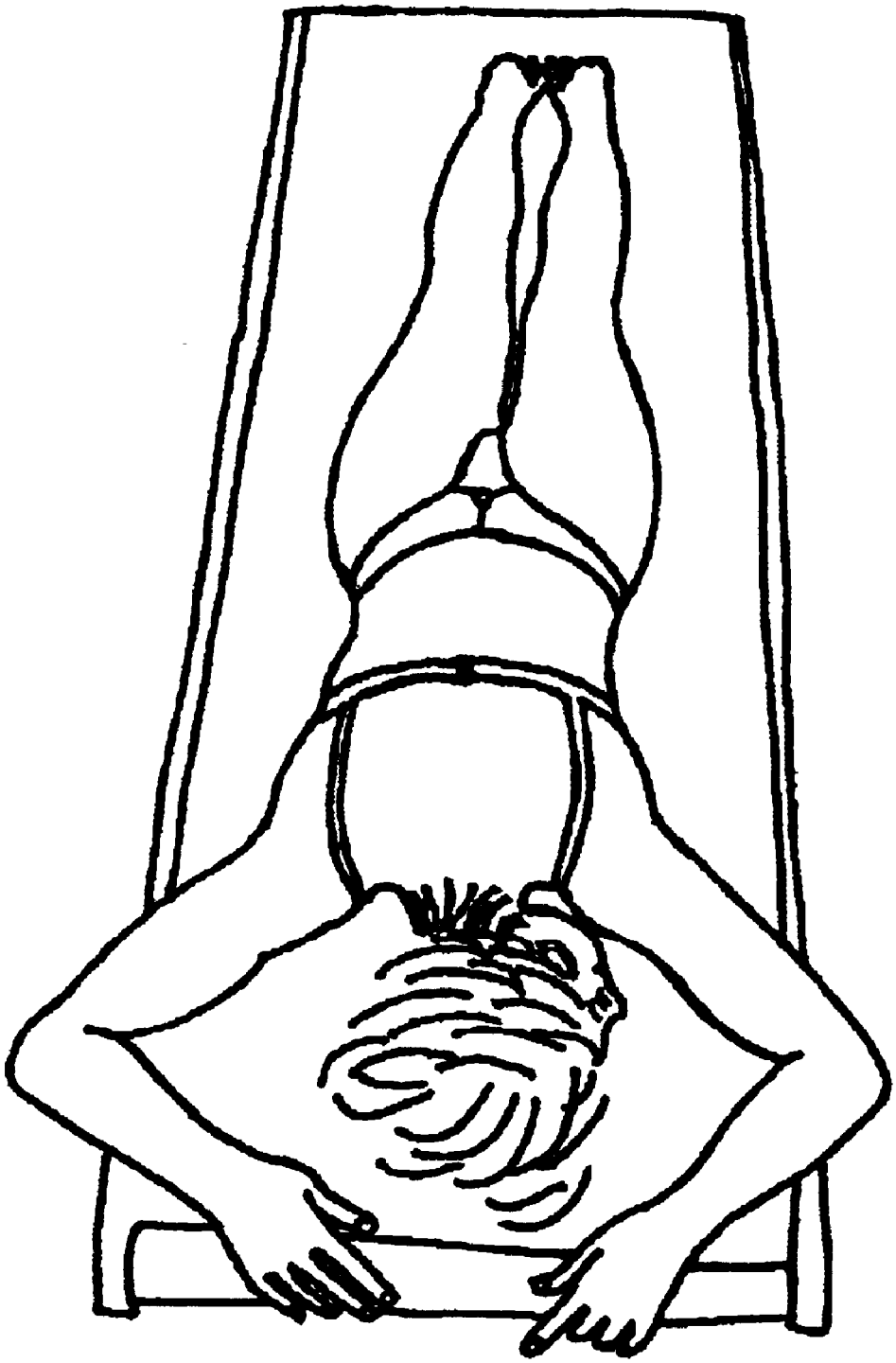
FIG. 14 illustrates the intended use of the swimsuit converter of present invention for sun bathing.

FIGS. 13A and 13B illustrate a real example of using the swimsuit converter of the present invention to convert the bottom rear panel of a bikini swimsuit into a thong. FIG. 14 further illustrates the intended use of the swimsuit converter of the present invention for sun bathing.

Figure 5:
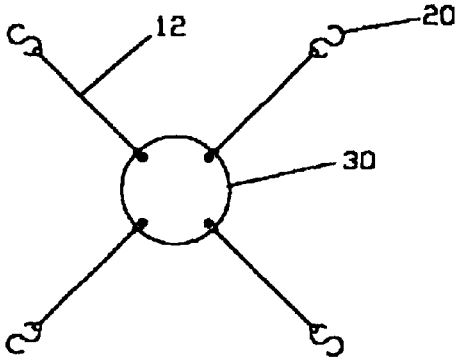
FIG. 5 is a perspective view of a swimsuit converter with four extensions of one embodiment of the present invention.
Figure 10:
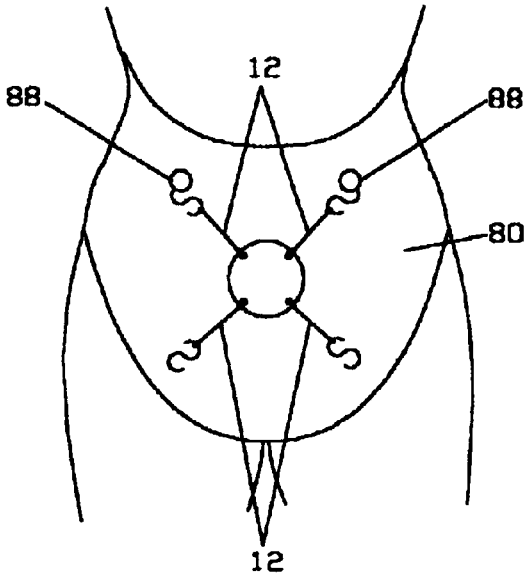
FIG. 10 shows a swimsuit converter with two attachment means attached to two attachment openings on the rear panel.

The swimsuit converters shown in FIGS. 1 to 4, and FIGS. 7 to 9 have three extensions 12. However, more than three extensions can be utilized for the purpose of the present invention, as shown in FIGS. 5 and 10. The length of each extension 12 can be the same, and can also be different, depending on the configuration of the swimsuit. For example, the extension attached to top edge 84 of rear panel 80, or loop 86 can be longer than the extensions attached to two sides 82 of rear panel 80, if top edge 84 or loop 86 has a relatively higher position.

Figure 15A:
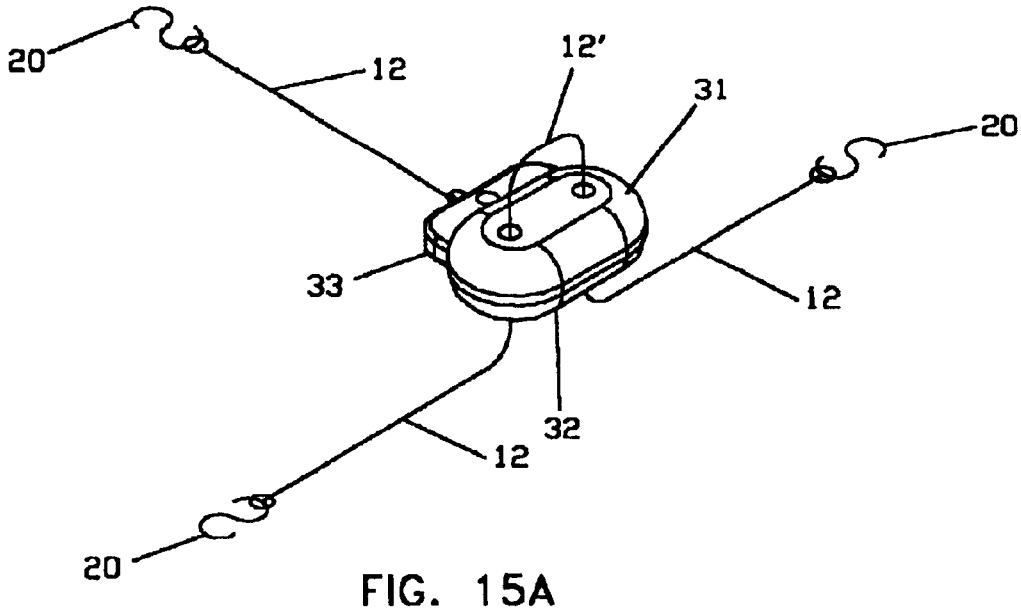
FIGS. 15A and 15B are two prospective views of an adjustable swimsuit converter of one embodiment of the present invention.
Figure 15B:
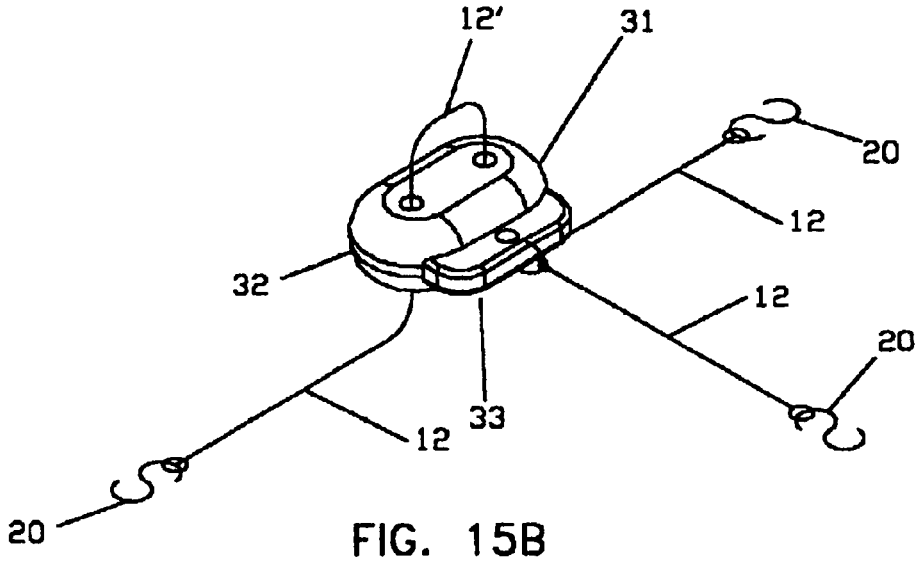

In a further embodiment, the present invention provides an adjustable center connection means 31 which has an adjustment mechanism for adjusting the length of extension 12. FIG. 15 shows an example of an adjustable swimsuit converter. In this case, two extensions 12 for attaching two sides of a swimsuit are connected together by an extension connector 12'. As shown, adjustable center connection means 31 has a holder 32 with two apertures housing extension connector 12', and spring loaded slide plate 33 inserted inside holder 32. With this device, a user can push in slide plate 33 and pull extension connector 12' to adjust the lengths of extensions 12 based on the swimsuit size, style, and user's individual needs. Other suitable adjustment means can also be utilized for the purpose of the present invention.

Figure 11:
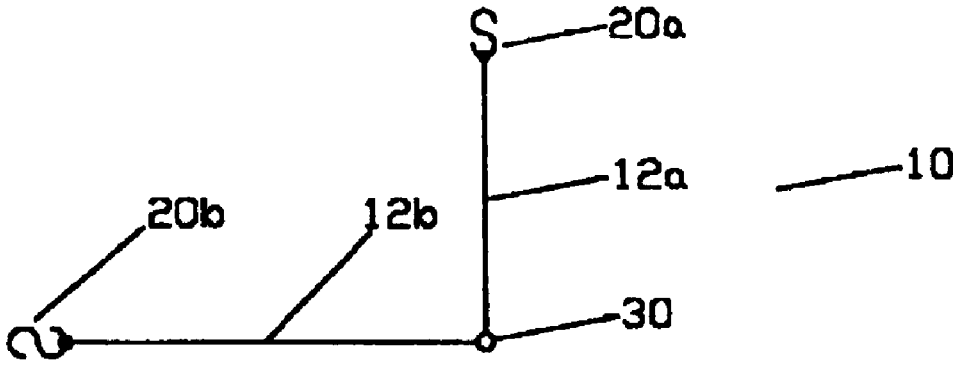
FIG. 11 shows an alternative embodiment of the swimsuit converter with two extensions.

In an alternative embodiment, swimsuit converter 10 has two extensions, 12*a* and 12*b*, as shown in FIG. 11. When in use, a swimsuit wearer attaches attachment means 20*a* to a location around the waist portion of a bottom rear panel of a swimsuit and enfolds the bottom rear panel of a swimsuit with extension 12*b*, and connects attachment means 20*b* to center connection means 30 to hold the rear panel together. More specifically, the extension 12*b* wraps around sides 82 of bottom panel 80 and attaches to center connection means 30.

Figure 12:
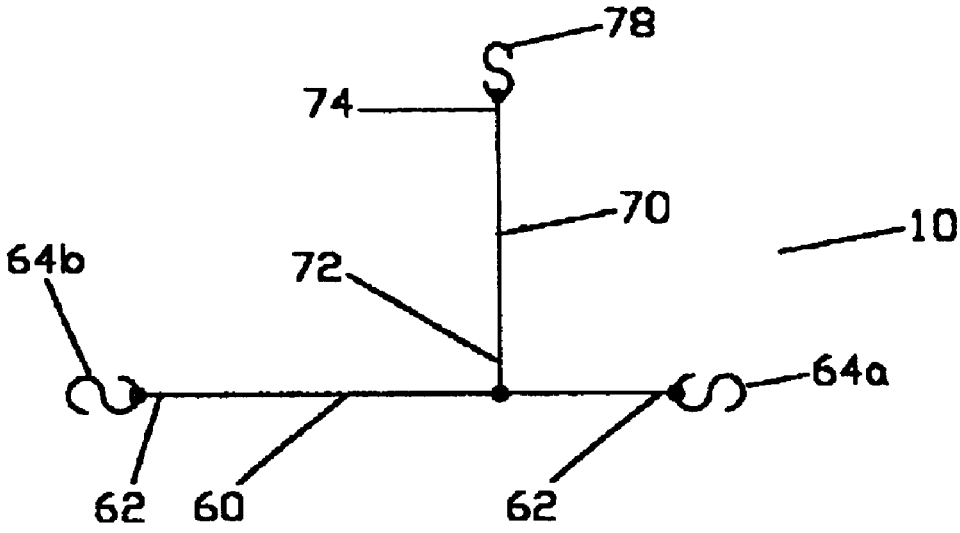
FIG. 12 is a perspective view of a swimsuit converter with two interconnected extensions of one embodiment of the present invention.

FIG. 12 illustrates a further embodiment with a similar method of use as the embodiment shown in FIG. 11. In this embodiment, swimsuit converter 10 comprises a first extension 60 having two ends 62, each of two end portions of first extension 60 having a connection means 64*a* or 64*b*, which enables interconnection between the connection means; and a second extension 70, a first end 72 of second extension 70 being connected to a point along first extension 60, and an attachment means 78 being connected to a second end portion 74 of second extension 70. When in use, a swimsuit wearer attaches attachment means 78 of second extension 70 to a location around the waist portion of a bottom rear panel of a swimsuit, has first extension 60 enfolding the bottom rear panel of the swimsuit, and connects connection means 64*a* with 64*b* to hold the rear panel together.

With this embodiment, connections means 64*a* and 64*b* are complimentary to each other. Suitable complimentary connections means include hooks, rings, buttons, clasps, clamps, snaps, loop and hook fastener, or other suitable means.

The swimsuit converter of the present invention provides a swimsuit wearer an ability to conveniently change a conventional style swimsuit, more suitable in a public environment, into a shape with more body exposures for sun bathing and sun tanning. Therefore, the present invention provides a practical solution for easy conversion of swimsuit styles between different environments. Furthermore, it costs much less to use the swimsuit converters of the present invention to convert swimsuit styles than possessing multiple swimsuits of different styles.

The swimsuit converter of the present invention can be sold as an after-market product for use with user's existing swimsuit, and it can also be sold together with a swimsuit as an accessory or decoration. Moreover, because of its decorative feature, the swimsuit converter of the present invention can also be used as a decoration of a thong style swimsuit, where a conversion is not even required.

In an additional embodiment, the present invention provides a kit for making a swimsuit converter. The kit comprises extension materials, a plurality of attachment means, center connection means, and an instruction on how to make a swimsuit converter. Because of its structural simplicity, low cost, and decorative features, users can make various swimsuit converters with their choices of color, material, and style. Using the kit a user can make swimsuit converters with or without the center connection means, with three or more extensions, or with only two extensions.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

We claim:

1. A swimsuit converter comprising:

a plurality of linear extensions, each of said linear extension having a first end portion, and a second opposing end portion being connected to an attachment means, wherein said plurality of linear extensions are connected together by said first end portion, wherein attaching two of said linear extensions through said attachment means to two sides of a bottom rear panel of a swimsuit, respectively, and attaching one or more of said linear extensions through said attachment means to one or more locations around the rear waist portion of said swimsuit enables a conversion of said bottom rear panel of said swimsuit to a shape which provides more body exposure.

2. The swimsuit converter of claim 1, wherein said conversion converts a bikini style bottom to a thong style bottom.

3. The swimsuit converter of claim 1, wherein said linear extension is one form selected from the group consisting of chains, strings, strips, stringed beads, and connected loops.

4. The swimsuit converter of claim 3, wherein said converter has three extensions.

5. The swimsuit converter of claim 1, wherein said attachment means is one selected from the group consisting of hooks, clasps, clamps, snaps, buttons, and hook and loop fastener.

6. A swimsuit converter comprising:

a center connection means, and a plurality of linear extensions extending radially from said center connection means, each said linear extension having a first end portion being connected to said center connection means, and a second opposing end portion being connected to an attachment means, wherein attaching two of said linear extensions through said attachment means to two sides of a bottom rear panel of a swimsuit and attaching one or more said linear extensions through said attachment means to one or more locations around the rear waist portion of said swimsuit enable a conversion of said bottom rear panel of said swimsuit to a shape which provides more body exposure.

7. The swimsuit converter of claim 6, wherein said conversion converts a bikini style bottom to a thong style bottom.

8. The swimsuit converter of claim 6, wherein said center connection means is a loop.

9. The swimsuit converter of claim 6, wherein said center connection means is a plate with a plurality of apertures positioned peripherally about said plate for connecting said plurality of linear extensions, said plurality of apertures spacing apart along said periphery of said plate.

10. The swimsuit converter of claim 6, wherein said center connection means has an adjustment mechanism for adjusting a length of said extension.

11. The swimsuit converter of claim 6, wherein said linear extension is one form selected from the group consisting of chains, strings, strips, stringed beads, and connected loops.

12. The swimsuit converter of claim 11, wherein said converter has three extensions.

13. The swimsuit converter of claim 6, wherein said attachment means is one selected from the group consisting of hooks, clasps, clamps, snaps, buttons, and hook and loop fastener.

14. A swimsuit converter comprising:

a center connection means; and two linear extensions, each linear extension having a first end portion being connected to said center connection means, and a second opposing end portion being connected to an attachment means, wherein attaching a first extension to a location around the waist portion of a bottom rear panel of a swimsuit, enfolding said bottom rear panel with a second extension and connecting said attachment means of said second extension to said center connection means to hold said rear panel together enables a conversion of said rear panel of said swimsuit to a shape which provides more body exposure.

15. A swimsuit converter comprising:

a first linear extension having two opposing end portions, each of said two end portions having a connection means enabling interconnection between said connection means, and a second linear extensions having a first end portion connected to a point along said first linear extension, and having a second end portion connected to an attachment means, wherein attaching said attachment means of said second linear extension to a location around the waist portion of a bottom rear panel of a swimsuit and having said first linear extension enfolding said bottom rear panel of said swimsuit and connecting said connection means enables a conversion of said rear panel of said swimsuit to a shape which provides more body exposure.

16. The swimsuit converter of claim 15, wherein said connection means at each end portion of said first linear extension is complementary of each other.

* * * * *